United States Patent [19]

Mitsuda et al.

[11] 4,250,706

[45] Feb. 17, 1981

[54] APPARATUS FOR CONTROLLING THE AMOUNT OF SECONDARY AIR FED INTO AN INTERNAL COMBUSTION ENGINE

[75] Inventors: Tadao Mitsuda, Susono; Takeru Yasuda, Nagoya; Toshimichi Asai, Obu, all of Japan

[73] Assignees: Toyota Jidosha Kogyo Kabushiki Kaisha, Toyota; Aisan Industry Co., Ltd., Obu, both of Japan

[21] Appl. No.: 947,507

[22] Filed: Oct. 2, 1978

[30] Foreign Application Priority Data

Nov. 16, 1977 [JP] Japan ..... 52/136573

[51] Int. Cl.³ ..... F01N 3/10; F02M 23/04

[52] U.S. Cl. ..... 60/276; 60/289; 123/589

[58] Field of Search ..... 60/276, 289, 290; 123/32 EE, 119 EC, 124 R, 124 B, 119 D, 119 DB

[56] References Cited

U.S. PATENT DOCUMENTS

| | | | |
|---|---|---|---|
| 4,104,879 | 8/1978 | Nohira | 60/290 |
| 4,112,678 | 9/1978 | Miyagi | 60/289 |
| 4,137,714 | 2/1979 | Takeda | 60/289 |
| 4,159,626 | 7/1979 | Shibata | 60/290 |
| 4,162,612 | 7/1979 | Mitsuda | 60/290 |

*Primary Examiner*—Douglas Hart

*Attorney, Agent, or Firm*—Stevens, Davis, Miller & Mosher

[57] ABSTRACT

Disclosed is an apparatus for controlling the amount of secondary air fed into an internal combustion engine. This apparatus includes means for causing a sudden change of the level of the absolute pressure signal for driving the secondary air flow control means each time the level of the output voltage of the air-fuel ratio sensor changes. Thus, the equivalent air-fuel ratio is maintained for a long time within a desired range so that the highest purifying efficiency of the three-way catalytic converter can be attained.

9 Claims, 7 Drawing Figures

APPARATUS FOR CONTROLLING THE AMOUNT OF SECONDARY AIR FED INTO AN INTERNAL COMBUSTION ENGINE

BACKGROUND OF THE INVENTION

The present invention relates to an apparatus for controlling the amount of secondary air fed into an intake passage or into an exhaust passage of an internal combustion engine for controlling an equivalent air-fuel ratio within a predetermined range.

In the field of this art, a method is known in which the equivalent air-fuel ratio is detected by an air-fuel ratio sensor, for example, an oxygen concentration sensor for detecting the concentration of oxygen in the exhaust gas, and then secondary air is fed into an intake passage or into an exhaust passage of an internal combustion engine according to the detected equivalent air-fuel ratio, for maintaining the equivalent air-fuel ratio within a predetermined range which is near the stoichiometric air-fuel ratio, whereby the effect of purifying pollutants in a three-way catalytic converter disposed in the exhaust system is improved.

In a conventional apparatus for carrying out the above-mentioned method, the amount of secondary air to be injected into the engine is controlled by an air flow control valve disposed in a passage between an air pump and a secondary air injection mechanism. The air flow control valve is driven by an absolute pressure signal applied thereto through an electromagnetic valve which is adapted for switching the transmission of the absolute pressure on or off in response to an electrical signal provided from the air-fuel ratio sensor.

In order to effectively carry out air-fuel ratio control processes wherein, the amount of secondary air fed into the engine is controlled, the driving speed of the air flow control valve should be rapidly changed when the operation for increasing or decreasing the amount of secondary air fed into the engine is started. Accordingly, if the driving speed of the air flow control valve is suddenly increased or decreased (so-called skipping action) when the operation for increasing or decreasing the amount of secondary air is started, and thereafter slowly controlled, the equivalent air-fuel ratio will be maintained for a long time within the range wherein the three-way catalytic converter operates at its highest purifying efficiency. As a result, the effect of purifying pollutants will be further improved.

SUMMARY OF THE INVENTION

It is an object of the present invention to provide an improved apparatus for controlling the amount of secondary air fed into an internal combustion engine, whereby the effect of purifying harmful pollutants in the exhaust gas can be further improved.

According to the present invention, an apparatus for controlling the amount of secondary air fed into an internal combustion engine comprises: means for generating an electrical signal of a level which indicates an equivalent air-fuel ratio condition of the engine; means for controlling the amount of secondary air to be fed into the engine, in accordance with a predetermined change in the level of an absolute pressure signal applied thereto; means for generating an absolute pressure signal by selectively communicating with an absolute pressure source and the atmosphere, in response to a predetermined level of the electrical signal, and for applying the generated absolute pressure signal to the above-mentioned controlling means; and means for causing a sudden change in the level of the absolute pressure signal each time the level of the above-mentioned electrical signal changes.

The above and other related objects and features of the present invention will be apparent from the following description of the present invention with reference to the accompanying drawings, as well as from the appended claims.

DETAILED DESCRIPTION OF THE INVENTION

Figure 1:
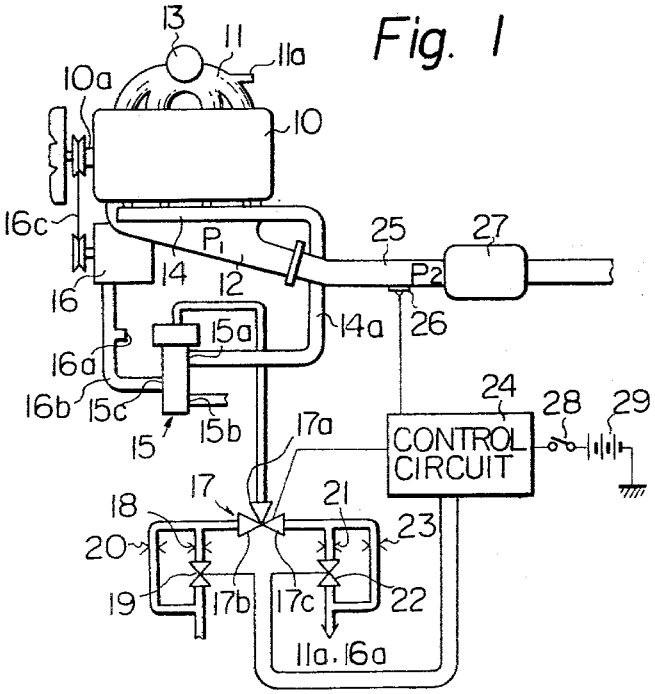
FIG. 1 is a schematic diagram of an internal combustion engine to which an apparatus for controlling the amount of secondary air according to the present invention is attached.

Referring to FIG. 1, which is a schematic diagram of an internal combustion engine having an apparatus according to the present invention, reference numeral 10 represents the body of the engine, 11 represents an intake manifold of the engine 10, 11*a* represents a vacuum take-out port of the intake manifold 11, and 12 represents an exhaust manifold of the engine 10. A carburetor 13 is mounted upstream of the intake manifold 11. A secondary air manifold 14 for injecting secondary air into the exhaust manifold 12 is mounted on the exhaust port portion of the exhaust manifold 12. The secondary air manifold 14 communicates, via a conduit 14*a*, with a first port 15*a* of an air flow control valve 15 which is a diaphragm-type three-port valve. A check valve (not shown) is generally mounted on the conduit 14*a*. A second port 15*b* of the air flow control valve 15 is opened to the atmosphere via, for example, an air cleaner (not shown). A third port 15*c* of the air flow control valve 15 communicates via a conduit 16*b*, with the discharge outlet of an air pump 16 which is driven by a crankshaft 10*a* of the engine 10 via a belt 16*c*. A suction inlet (not shown) of the air pump 16 is opened to the atmosphere via, for example, an air cleaner (not shown). Therefore, secondary air can be introduced into the third port 15*c* of the air flow control valve 15 according to the operation of the air pump 16.

A diaphragm chamber for controlling a diaphragm 30 (FIG. 2*a*) in the air flow control valve 15 communicates with a first port 17*a* of an electromagnetic valve 17 of a three-port valve. A second port 17*b* of this electromagnetic valve 17 can be opened to the atmosphere via an orifice 18 and an electromagnetic valve 19 of a two-port valve, and is further opened to the atmosphere via an orifice 20. A third port 17*c* of the valve 17 can communicate, via an orifice 21 and an electromagnetic valve 22 of a two-port valve, with the vacuum take-out port 11*a* of the intake manifold 11 or with a positive pressure take-out port 16*a* on the conduit 16*b* for feeding the discharge pressure provided from the air pump 16. The third port 17*c* also communicates, via an orifice 23, with the vacuum take-out port 11*a* or with the positive pressure take-out port 16*a*.

Exciting coils 17*d*, 19*a* and 22*a* (shown in FIG. 3) of electromagnetic valves 17, 19 and 22 are electrically connected to a control circuit 24, respectively. The electromagnetic valve 17 is arranged so that when the exciting coil 17*d* thereof is energized, the first port 17*a* communicates with the third port 17*c*, and that when de-energized, the first port 17*a* communicates with the second port 17*b*. The electromagnetic valves 19 and 22 are respectively opened when each of the exciting coils 19*a* and 22*a* is energized, and respectively closed when de-energized.

An exhaust pipe 25 is connected downstream of the exhaust manifold 12. An air-fuel ratio sensor 26, for example, an oxygen concentration sensor for detecting the equivalent air-fuel ratio, is mounted on the exhaust pipe 25. A three-way catalytic converter 27 for reducing the three main pollutants, i.e., $NO_x$, CO and HC components, in the exhaust gas is mounted in the exhaust pipe 25 downstream of the air-fuel ratio sensor 26. The output terminal of the air-fuel ratio sensor 26 is electrically connected to the control circuit 24. An output terminal of a battery 29 is also electrically connected to the control circuit 24 through an ignition switch 28.

Figure 2A:
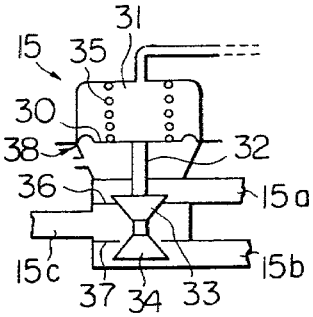
FIGS. 2*a* and 2*b* are schematic sectional diagrams illustrating two respective embodiments of an air flow control valve shown in FIG. 1.

FIG. 2*a* illustrates the structure of the air flow control valve 15 which uses vacuum in the intake manifold 11 as a carrier of the absolute pressure signal for driving the diaphragm of the valve 15. In FIG. 2*a*, reference numerals 30 and 31 represent a diaphragm and a diaphragm chamber, respectively. The diaphragm 30 is connected to valve members 33 and 34 by means of a rod 32. The mid portion of the rod 32 is slidably supported by a body 38 of the air flow control valve 15. A diaphragm-return spring 35 is disposed in the chamber 31 for the purpose of pressing against the diaphragm 30. This control valve 15 is so arranged that when the pressure level in the diaphragm chamber 31 is equal to the atmospheric pressure level, the valve member 33 is rested on a valve seat 36 and the valve member 34 is positioned apart from a valve seat 37, as shown in FIG. 2*a*. Therefore, when the electromagnetic valve 17 is electrically de-energized, since the pressure level in the chamber 31 becomes equal to the atmospheric pressure level, the second port 15*b* is communicated with the third port 15*c*.

Contrary to the above, when the electromagnetic valve 17 is electrically energized, since the vacuum in the intake manifold 11 is applied to the chamber 31, the diaphragm 30 is driven in a direction opposite that of the pressing force caused by the spring 35, and also, the valve members 33 and 34 are driven to open and to close the valve seats 36 and 37, respectively. Accordingly, in this case, the first port 15*a* is communicated with the third port 15*c*.

The electromagnetic valves 19 and 22 are so arranged as to cause the driving speed of the valve members 33 and 34 to suddenly increase when the driving direction thereof is changed.

Orifices 18, 20, 21 and 23 are adapted for controlling the driving speed of the diaphragm 30, namely, for controlling the speed for transmitting the absolute pressure signal through each of these orifices, to a desirable speed. The inner cross-sectional area of the orifice 20 is selected to be preferably greater than that of the orifice 23, and also the inner cross-sectional area of the orifice 18 is selected to be preferably greater than that of the orifice 21. However, the inner cross-sectional areas of these orifices 18 and 21 should be determined in accordance with the time period for energizing the electromagnetic valves 19 and 22.

Figure 2B:
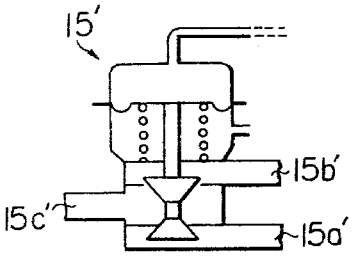

FIG. 2*b* illustrates the structure of another embodiment of the air flow control valve according to the preset invention. In FIG. 2*b*, an air flow control valve 15' has substantially the same function as that of the air flow control valve 15 shown in FIG. 2*a*, except that this control valve 15' is driven by the positive pressure signal which uses a carrier of, for example, the discharge pressure of the air pump 16, instead of being driven by the negative pressure signal which uses a carrier of the vacuum in the intake manifold 11.

Figure 3:
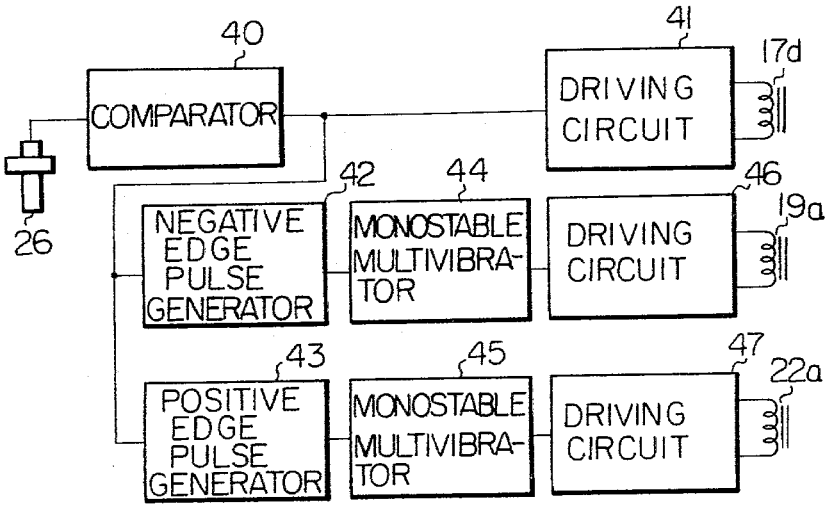
FIG. 3 is a block diagram of a control circuit shown in FIG. 1.

Fig. 3 is a block diagram illustrating the control circuit 24 shown in FIG. 1. As shown in FIG. 3, the output terminal of the air-fuel ratio sensor 26 is connected to the input terminal of a comparator 40. The output terminal of the comparator 40 is connected to each of the input terminals of a driving circuit 41, a negative edge pulse generator 42 and a positive edge pulse generator 43. The output terminals of the pulse generators 42 and 43 are respectively connected to the input terminals of driving circuits 46 and 47 through monostable multivibrators 44 and 45. The output terminals of the driving circuits 41, 46 and 47 are connected to the exciting coils 17*d*, 19*a* and 22*a* of the electromagnetic valves 17, 19 and 22*a*, respectively.

The operation of the apparatus of the present embodiment will now be described.

Figure 5:
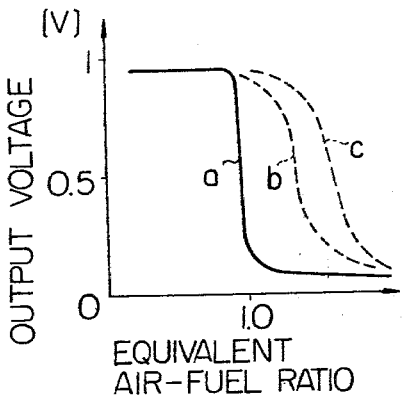
FIG. 5 is a graph illustrating the characteristics of an air-fuel ratio sensor shown in FIG. 1.

The air-fuel ratio sensor 26 is a well-known oxygen concentration sensor using zirconium oxide as an oxygen ion conductor. As shown by a solid line a in FIG. 5, the air-fuel ratio sensor 26 usually generates an output voltage of about 1 V when the equivalent air-fuel ratio is lower than the stoichiometric air-fuel ratio, namely, when the engine is maintained on a rich side of stoichiometric conditions. Furthermore, the sensor 26 usually generates an output voltage of about 0.1 to 0.2 V when the equivalent air-fuel ratio is higher than the stoichiometric air-fuel ratio, namely, when the engine is maintained on the lean side of stoichiometric conditions.

Figure 4:
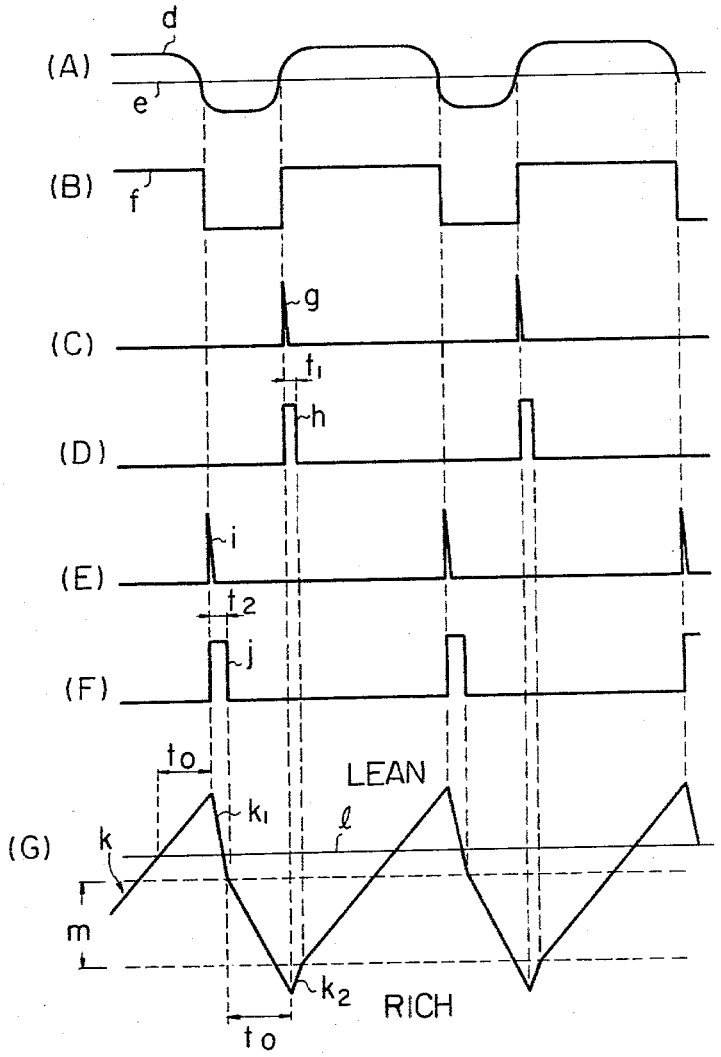
FIG. 4 shows waveforms obtained at various points in the control circuit shown in FIG. 3.

As shown in FIG. 4-(A), the level of the output voltage d of the air-fuel ratio sensor 26 (FIG. 3) is applied to the comparator 40 (FIG. 3) and compared with the level of the reference voltage e. Thus, as shown in FIG. 4-(B), while the equivalent air-fuel ratio of the exhaust gas near the air-fuel ratio sensor 26 is on the rich side of stoichiometric conditions (hereinafter this condition is referred to as a rich condition), the level of the output voltage f of the comparator 40 will become high, and while the equivalent air-fuel ratio of the exhaust gas near the sensor 26 is on the lean side of stoichiometric conditions (hereinafter referred to as a lean condition), the level of the output voltage f becomes low. Since the output voltage f is applied to the driving circuit 41 (FIG. 3), the exciting coil 17*d* (FIG. 1) of the electromagnetic valve 17 (FIG. 1) is energized during the rich condition so as to provide the diaphragm chamber of the air flow control valve 15 (FIG. 1) or 15' (FIG. 2*b*) with a negative pressure or a positive pressure via the orifice 23 (FIG. 1). The ouput voltage f of the comparator 40 is also applied to the positive edge pulse generator 43 (FIG. 3) and a triggering pulse g, as shown in FIG. 4-(C), is formed by the generator 43 at the point where the level of the output voltage f changes from low to high, namely at the positive edge of the output voltage f. This triggering pulse g is applied to the monostable multivibrator 45 (FIG. 3) so as to generate a pulse h having a predetermined duration of $t_1$, as shown in FIG. 4-(D). Then, the generated pulse h is applied to the driving circuit 47 (FIG. 3) so as to energize the exciting coil 22*a* (FIG. 3) of the electromagnetic valve 22 (FIG. 1) during a period of time corresponding to the duration of the pulse h. Therefore, the valve 22 is opened for this period and a negative pressure or a positive pressure is rapidly applied to the diaphragm chamber of the air flow control valve 15 or 15' via the valve 22 and the orifice 21 (FIG. 1). As a result, when the exhaust gas exhibits a rich condition, a secondary air fed from the air pump 16 (FIG. 1) is applied to the exhaust manifold 14 (FIG. 1), and particularly, the amount of secondary air is suddenly increased when the operation for applying secondary air is started.

When the rich condition of the exhaust gas is changed to a lean condition, since the exciting coil 17*d* of the electromagnetic valve 17 is de-energized, the diaphragm chamber of the valve 15 or 15' is opened to the atmosphere via the orifice 20 (FIG. 1). Furthermore, a triggering pulse i is formed by the negative edge pulse generator 42 (FIG. 3) at the negative edge of the output voltage f of the comparator 40, as shown in FIG. 4-(E), and then applied to the monostable multivibrator 44 (FIG. 3) so as to generate a pulse j having a predetermined duration of $t_2$, as shown in FIG. 4-(F). Then the generated pulse j is applied to the driving circuit 46 so as to energize the exciting coil 19*a* of the electromagnetic valve 19 during a fine period corresponding to the duration of the pulse j. Therefore, the valve 19 is opened for this period and a negative pressure or a positive pressure in the diaphragm chamber of the air flow control valve 15 or 15' is rapidly reduced toward the atmospheric pressure level. As a result, when the condition of the exhaust gas is lean, the amount of secondary air which has been fed into the exhaust manifold 14 is decreased; particularly, the amount of secondary air is suddenly decreased when the operation for decreasing secondary air is started.

The characteristics of the equivalent air-fuel ratio correspnding to the above-mentioned operation of this embodiment will now be described with reference to FIG. 4-(G). In FIG. 4-(G), a solid line k indicates the characteristics of the equivalent air-fuel ratio of the exhaust manifold 14 (FIG. 1) (hereinafter referred to as a place $P_1$ as shown in FIG. 1) and the other solid line l indicates a threshold value of the equivalent air-fuel ratio where the output voltage level of the air-fuel ratio sensor 26 (FIG. 1) is changed. Furthermore, the reference letter m in FIG. 4-(G) indicates a range (window) of equivalent air-fuel ratios, wherein the three-way catalytic converter 27 can attain the highest efficiency in purifying the pollutants in the exhaust gas.

When the equivalent air-fuel ratio of the exhaust gas in the exhaust pipe 25 (FIG. 1) near the air-fuel ratio sensor 26 (hereinafter this part is referred to as a place $P_2$ as shown in FIG. 1) exceeds the threshold valve l and the condition of the exhaust gas at the place $P_2$ becomes lean, since the level of the output voltage f of the comparator 40 (FIG. 3) changes to a low level, as described before, and the amount of secondary air is reduced, the equivalent air-fuel ratio k at the place $P_1$ is decreased, in other words transferred to the rich side. In this case, since the air flow control valve 15 or 15' is operated with a skipping action, as mentioned before, the equivalent air-fuel ratio is rapidly decreased for a time period of $t_2$, as shown by $k_1$ in FIG. 4-(G).

It should be noted that the characteristics of the equivalent air-fuel ratio k shown in FIG. 4-(G) are characteristics of the equivalent air-fuel ratio of the exhaust gas at the place $P_1$, and the detection of the equivalent air-fuel ratio by the air-fuel ratio sensor 26 is carried out at the place $P_2$. Since a time delay of $t_0$ exists with respect to the gas flow between the place $P_1$ and the place $P_2$, when the equivalent air-fuel ratio at the place $P_2$ corresponds to the threshold value l, the equivalent air-fuel ratio at the place $P_1$ is practically on the rich side or on the lean side.

When the equivalent air-fuel ratio of the exhaust gas at the place $P_2$ is less than the threshold value l and the condition of the exhaust gas at the place $P_2$ becomes rich, since the amount of secondary air is increased the equivalent air-fuel ratio k at the place $P_1$ is increased, in other words, transferred to the lead side. In this case, since the air flow control valve 15 or 15' is also operated with the skipping action, the equivalent air-fuel ratio is instantly increased for a time period of $t_1$, as shown by $k_2$ in FIG. 4-(G).

As mentioned hereinabove, according to the present invention, the amount of secondary air fed to the engine is suddenly changed in accordance with the skipping action when the increasing or decreasing operation is started. Accordingly, the equivalent air-fuel ratio will be maintained within the effective range of the three-way catalytic converter for a long time, and the purifying efficiency for the exhaust gas will thereby become extremely improved.

An internal combustion engine in which the air-fuel ratio of the air-fuel mixture taken into the engine is maintained on the rich side of stoichiometric conditions and in which the exhaust gas is then controlled to stoichiometric conditions by providing the exhaust manifold with secondary air generally has the following problem. The air-fuel ratio sensor of such engine may sometimes generate an output voltage of a level which is changed in accordance with the lean side of stoichiometric conditions, as shown by the broken line b or c in FIG. 5. This is because a thermodynamic equilibrium between the air and the gaseous fuel in the exhaust gas cannot be attained in such engine .

In order to compensate for the undesirable operation of the air-fuel ratio sensor a system has already been proposed wherein the inner cross-sectional area of the orifice 20 is selected to be larger than that of the orifice 23 and thus the driving speed of the air flow control valve 15 or 15' during the operation for decreasing secondary air fed into the engine, is higher than that during the operation for increasing the secondary air (for example, as described in the specification of Japanese Patent Application No. 52-076174).

The present invention can be adapted to such a system for attaining a more desirable air-fuel ratio control, because the apparatus according to the present invention can easily vary the degree of the skipping action corresponding to whether the amount of secondary air fed into the engine is increased or decreased. In practice, the degree of the skipping action is easily controlled by varying the respective inner cross-sectional areas of the orifices 18 and 21, or by varying the time periods of $t_1$ and $t_2$ for energizing the respective electromagnetic valves 19 and 22.

In the aforementioned embodiment according to the present invention, the periods of $t_1$ and $t_2$ for energizng each of the electromagnetic valves 19 and 22, in other words, the periods for carrying out the skipping action, are maintained at predetermined values, respectively. However, in some embodiments of the present invention, these periods of $t_1$ and $t_2$ may be controlled in proportion to the period during which the exhaust gas exhibits a rich condition or a lean condition. Furthermore, in other embodiments of the present invention, the skipping action may be carried out only when a lean condition or a rich condition is continually maintained for a time period which is longer than a predetermined period. Control circuits for attaining the above-mentioned skipping action can be easily constructed by one skilled in this art.

Figure 6:
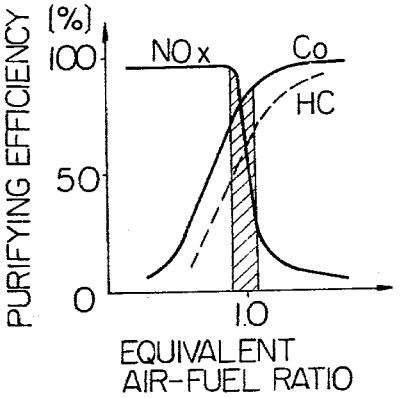
FIG. 6 is a graph illustrating the characteristics of a three-way catalytic converter shown in FIG. 1.

FIG. 6 illustrates the relationship between the purifying efficiency of the three-way catalytic converter and the equivalent air-fuel ratio. As shown in FIG. 6, the three-way catalytic converter can attain the highest efficiency for simultaneously purifying the three main harmful pollutants in the exhaust gas when the equivalent air-fuel ratio is within a very narrow range (shown as the hatched zone in FIG. 6), which range is near the stoichiometric air-fuel ratio.

As will be apparent from the foregoing description, since the apparatus for controlling the amount of secondary air fed into the engine according to the present invention comprises means for causing a sudden change of the level of the absolute pressure signal for driving the air flow control means each time the level of the output voltage of the air-fuel ratio sensor changes, the amount of secondary air fed into the engine is increased or decreased with the skipping action.

As a result, the equivalent air-fuel ratio of the exhaust gas is maintained for a long time within the effective range of the three-way catalytic converter. Accordingly, the purifying efficiency of the catalytic converter can be remarkably improved.

As many widely different embodiments of the present invention may be constructed without departing from the spirit and scope of the present invention, it should be understood that the present invention is not limited to the specific embodiments described in this specification, except as defined in the appended claims.

What is claimed is:

1. An apparatus for controlling the amount of secondary air fed into an internal combustion engine, said apparatus comprising:

means for generating a first electrical signal having two voltage levels which are selected in accordance with an air-fuel ratio condition of said engine;

a control unit, electrically connected to said first signal generating means, for generating second and third electrical signals at the negative edge and the positive edge of said first electrical signal, respectively, said second and third electrical signals having predetermined pulse durations;

a single air control valve having only one control chamber to which an absolute pressure signal is applied, said valve, responding to the pressure level in said control chamber, controlling the amount of secondary air to be fed into said engine;

a first switching valve means, electrically connected to said first signal generating means, for generating an absolute pressure signal by selectively communicating said control chamber of said air control valve with an absolute pressure source and with the atmosphere, in response to the voltage level of said first electrical signal;

a second switching valve means, electrically connected to said control unit, for increasing the cross-sectional area of a passage between said first switching valve means and the atmosphere, so as to cause a quick decrease of the level of said absolute pressure signal, when said second electrical signal is generated; and a third switching valve means, electrically connected to said control unit, for increasing the cross-sectional area of a passage between said first switching valve means and the absolute pressure source, so as to cause a quick increase of the level of said absolute pressure signal, when said third electrical signal is generated.

2. An apparatus for controlling the amount of secondary air as claimed in claim 1, wherein said first switching valve means communicates said control chamber with the absolute pressure source when the level of said first electrical signal indicates a rich air-fuel condition, and communicates said control chamber with the atmosphere when the level of said first electrical signal indicates a lean air-fuel condition.

3. An apparatus for controlling the amount of secondary air as claimed in claim 2, wherein said first switching valve means comprises an electromagnetic three-port valve, which is energized or de-energized in response to the voltage level of said first electrical signal.

4. An apparatus for controlling the amount of secondary air as claimed in claim 1, wherein said second and third switching valve means comprise electromagnetic two-port valves which open when said second and third electrical signals are inputting, respectively.

5. An apparatus for controlling the amount of secondary air as claimed in claim 1, wherein said control unit comprises a first monostable circuit which is triggered at the negative edge of said first electrical signal and said second electrical signal having a predetermined pulse duration, and a second monostable circuit which is triggered at the positive edge of said first electrical signal and generates said third electrical signal having a predetermined pulse duration.

6. An apparatus for controlling the amount of secondary air as claimed in claim 4 or 5, wherein the pulse duration of said second electrical signal is determined so as to be longer than the pulse duration of said third electrical signal.

7. An apparatus for controlling the amount of secondary air as claimed in claim 1, wherein said engine has an intake manifold, and said absolute pressure signal includes a negative pressure signal applied from said intake manifold.

8. An apparatus for controlling the amount of secondary air as claimed in claim 1, wherein said engine has an air pump for driving secondary air and said absolute pressure signal includes a positive pressure signal applied from said air pump.

9. An apparatus for controlling the amount of secondary air as claimed in claim 1, wherein said first electrical signal generating means comprises an air-fuel ratio sensor for generating an electrical signal having a voltage level corresponding to the concentration value of a predetermined constituent gas in said exhaust gas, and a comparator for comparing the level of said generated electrical signal of said air-fuel ratio sensor with a predetermined reference voltage, said comparator outputting said first electrical signal.

* * * * *